United States Patent [19]

Dillinger

[11] 4,015,304

[45] Apr. 5, 1977

[54] DRILLING OR REAMING MACHINE

[76] Inventor: Lester L. Dillinger, 8632 Park St., Bellflower, Calif. 90706

[22] Filed: June 30, 1975

[21] Appl. No.: 591,522

Related U.S. Application Data

[63] Continuation of Ser. No. 464,051.

[52] U.S. Cl. ..... 15/104.1 R

[51] Int. Cl.[2] ..... B08B 9/02

[58] Field of Search ..... 15/104.1 R; 408/130

[56] References Cited

UNITED STATES PATENTS

| | | | |
|---|---|---|---|
| 690,878 | 1/1902 | Roan | 15/104.1 R |
| 2,803,842 | 8/1957 | Fuller | 15/104.1 R |
| 3,771,187 | 11/1973 | Dillinger | 15/104.1 R |
| 3,778,858 | 12/1973 | Fuller | 15/104.1 R |

*Primary Examiner*—Edward L. Roberts

[57] ABSTRACT

A drilling machine especially adapted for reaming tubes includes an elongated hollow drive shaft having a cutterhead attached to its forward end and a drive piston attached to its rearward end. Fluid pressure is applied to the rear end face of the drive piston in order to propel the drive shaft forward, while concurrently supplying fluid which flows out through openings in the cutterhead so as to flush the materials being reamed from a tube that is being cleaned. The machine includes a reversible drive flow for the fluid pressure system. It also includes a separate rotating drive for imparting rotation to the drive shaft.

6 Claims, 7 Drawing Figures

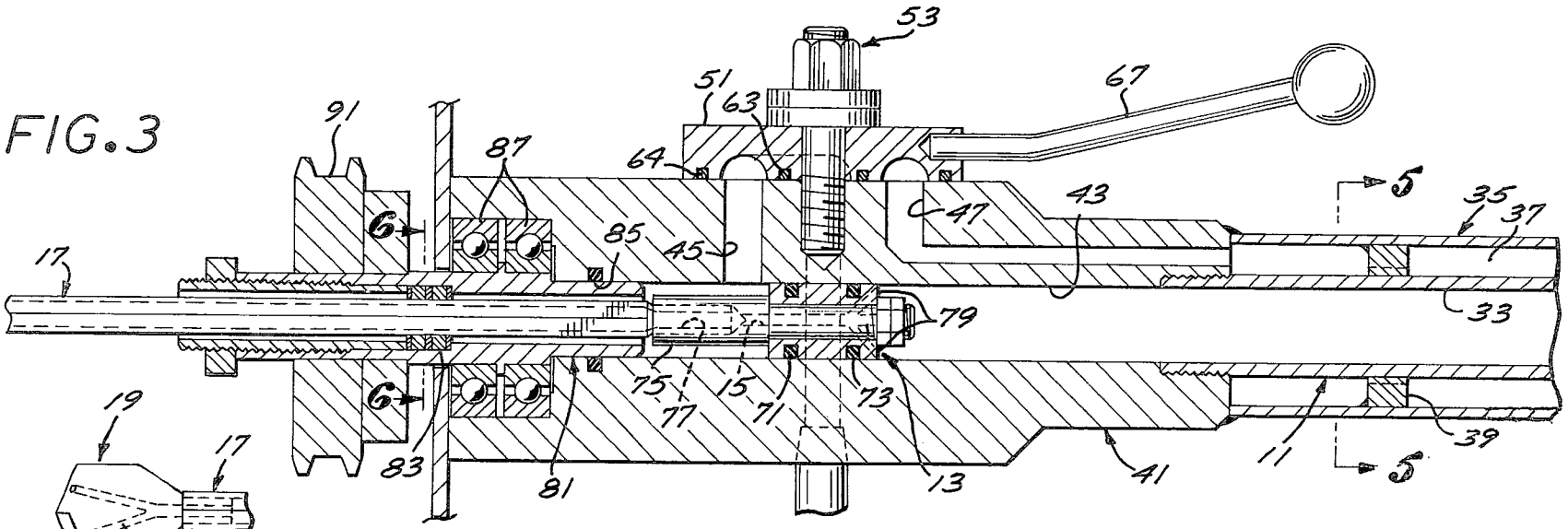
FIG. 3
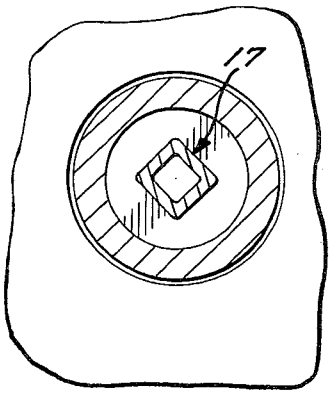
FIG. 6
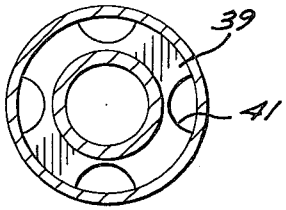
FIG. 5
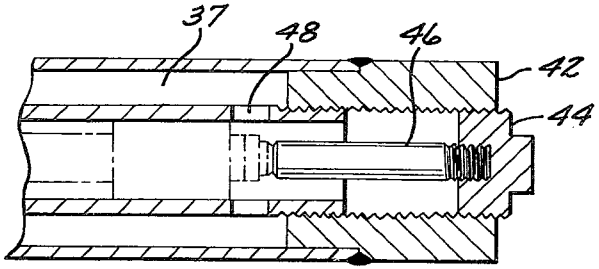
FIG. 4
FIG. 7

DRILLING OR REAMING MACHINE

RELATED APPLICATION

This application is a continuation of my prior copending application Ser. No. 464,051, filed Apr. 25, 1974, and subsequently abandoned.

BACKGROUND OF THE INVENTION

The present invention relates to reamers utilized to ream out the residue deposited in heat exchanger tubes and the like.

PRIOR ART

The prior art is well illustrated in the Fuller Pat. No. 2,803,842 issued in 1957. The machine there illustrated includes a square, hollow drive shaft which is rotatably driven through a mechanism similar to conventional kelly drive systems. In addition, a drive piston attached to the rearward end of the drive shaft reciprocates longitudinally within a very long cylinder, for either drivingly inserting the cutterhead into a heat exchanger tube that is to be reamed, or withdrawing it after the reaming and cleaning operation has been completed. The Fuller Patent also illustrates a hydraulic pressure system for applying hydraulic pressure into the cylinder in either a forward or reverse direction. A reversing switch is used to control the forward or reverse direction of the drive.

In the type system shown in the Fuller patent, it is found economical to use the same hydraulic pressure that drives the cutterhead forward for the additional purpose of flushing out the cuttings as they are dislodged. For this purpose an opening is formed in the rear end face of the drive piston, which communicates through the hollow drive shaft with openings in the cutterhead. Thus, application of hydraulic pressure to drive the piston, drive shaft, and cutterhead forward also concurrently produces a flushing action in the location where the cutterhead is operative.

Other relevant prior art includes the Dillinger Pat. No. 3,771,187 and the Fuller Pat. No. 3,778,858.

SUMMARY OF THE INVENTION

The important features of the present invention lie in the rearrangement of parts of the machine, such that it is easier and cheaper to manufacture and is also more reliable in operation as well as more convenient to operate.

The foregoing and other objects and advantages of the invention will become apparent from the following detailed description taken in conjunction with the accompanying drawings.

DRAWING SUMMARY

FIG. 3 is a longitudinal sectional view taken along a line 3—3 of FIG. 2;

FIG. 4 is a longitudinal sectional view, in enlarged scale, taken along the line 4—4 of FIG. 1;

FIG. 5 is a transverse sectional view taken along the line 5—5 of FIG. 3;

FIG. 6 is a transverse sectional view, in enlarged scale, taken along the line 6—6 of FIG. 3; and FIG. 7 is a detail view, in enlarged scale, taken from the circle 7 in FIG. 1.

PREFERRED EMBODIMENT

Figure 1:
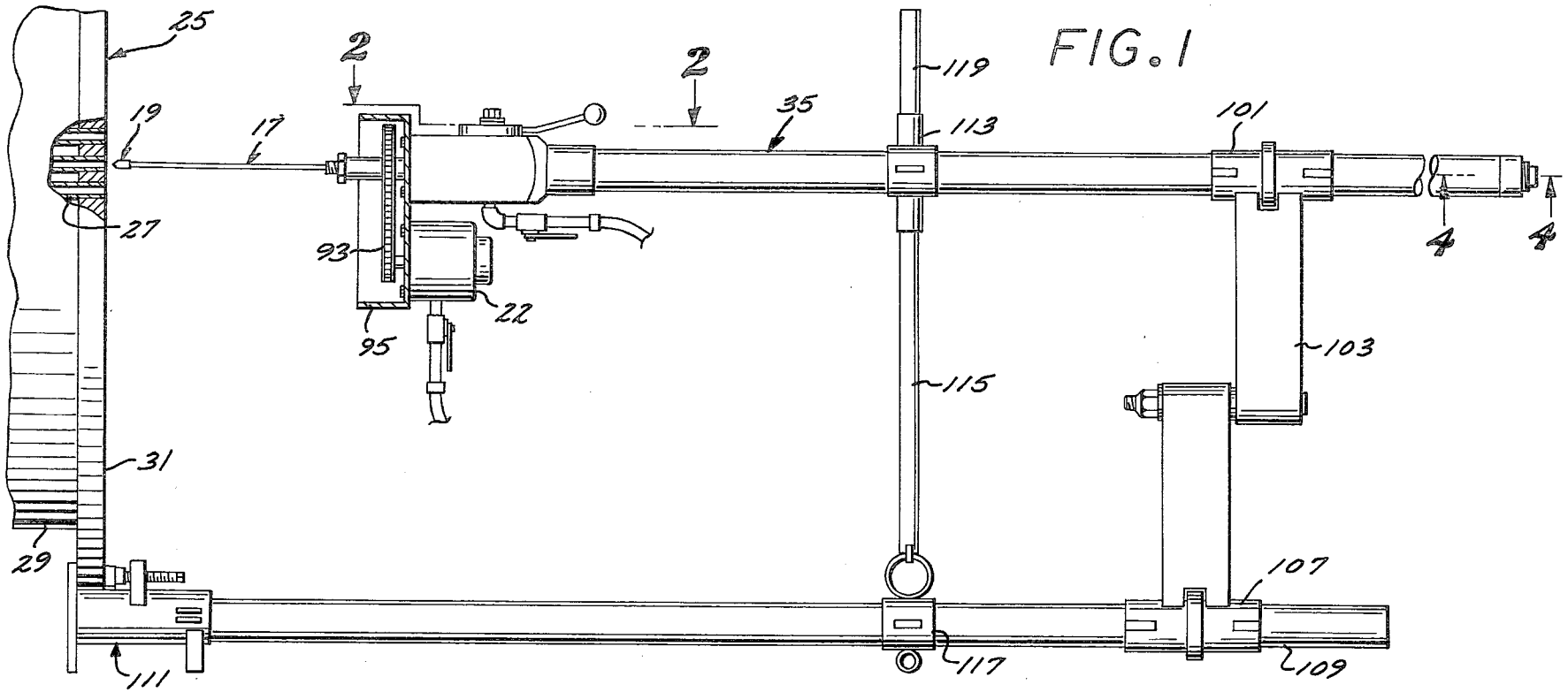
FIG. 1 is a broken plan view of a high pressure flush fluid reamer incorporating the present invention.

The drilling machine of the present invention illustrated particularly as a machine for reaming heat exchanger tubes is attached to a heat exchanger in the same general manner as has been described in the Roan Pat. No. 690,878 and in the Fuller Pat. No. 2,803,842. As shown in FIG. 1 of the present drawings, a number of heat exchanger tubes 27 project to the end face 25 of the heat exchanger. A parametral flange 31 which projects beyond the outer wall 29 of the heat exchanger provides a base for attachment of the machine.

The mechanism for attaching the reamer machine to the heat exchanger, and supporting and aligning it, and readjusting it as successively different heat exchanger tubes are to be cleaned, is substantially identical to the mechanism shown in the prior Dillinger Pat. No. 3,771,187. A lower frame 109, 111 is attached to the flange 31 of the heat exchanger. From the lower frme 109 a first vertical adjustment mechanism including parts 101, 103, and 107 extends upwardly. A second vertical adjustment mechanism including parts 115, 117, 113, and 119 also extends upwardly from the lower frame 109. The main body of the present machine is designated by the numeral 35, and as shown in FIG. 1 of the present drawings it is supported by the frame devices 101, 113.

Within the present machine the rotating drive system for imparting rotation to the hollow drive shaft 17 is also generally conventional. It is similar to the rotating drive mechanism shown in both the Fuller Pat. No. 2,803,842 and the Dillinger Pat. No. 3,771,187. It is also similar to the conventional kelly drive system used, for example, in well drilling equipment.

Thus at the forward or left hand end of the main body 35 of the machine there is an extension member 41 which fulfills a variety of purposes. A spindle 81 is located partially within the forward end of extension member 41, but also extends forwardly some distance beyond it. Bearings 87 support spindle 81 within the extension member 41 for rotation relative thereto. See FIG. 3. A pulley wheel 91 is attached to the extending portion of the spindle for drivingly rotating the spindle. As shown in FIG. 1, a drive motor 22 is coupled by means of a drive chain 93 to the pulley wheel 91. Contained within the longitudinal center of the spindle 81 is a roller type bushing 83, having a square opening, through which the square and hollow drive shaft 17 extends. Regardless of whether drive shaft 17 is being driven forward, or being driven in reverse, or maintaining its longitudinal position, motor 22 is effective for imparting the desired amount of rotation to the drive shaft.

The system for imparting forward drive to the drive shaft 17 is of the same general type as disclosed in the Fuller Pat. No. 2,803,842. That is, a drive piston 13 is attached through an intermediate device 75 to the rearward end of the drive shaft 17. The main body 35 of the machine includes an inner cylindrical member 11 whose interior wall provides an elongated cylinder 33. Typically, cylindrical member 11 is a standard pipe section having a length of 20 feet. Extension member 41 is threadedly attached to the forward end of the pipe 11, and has an interior cylindrical opening 43 which provides a forward extension of the cylindrical opening 33. As clearly shown in FIG. 3, the drive piston 13 reciprocates within the elongated chamber 33, 43 of the present machine.

A reverse drive opening 45 extends laterally through the forward extension member or base member 41 into its cylindrical chamber 43. See FIG. 3. At the rearward end of pipe 11 a forward drive opening 48 communicates with its interior portion. See FIG. 4. Fluid pressure, applied in either a forward or reverse direction, is effective to drive the piston 13, and hence drive shaft 17 with its cutterhead 19 in either a forward or reverse direction.

FIG. 6 illustrates a detail of the rotating drive of the drive shaft 17.

The main body 35 of the present machine includes, in addition to the inner cylinder or pipe 11, an outer cylinder or pipe identified only by the same numeral 35. Outer pipe 35 is considerably larger in diameter than the inner pipe 11, and there is a substantial annular space 37 between them. See FIG. 3. A series of spacer rings 39 support the pipes in their concentrically spaced relationship, as shown in FIG. 5. Openings 41 in spacers 39 provide a longitudinal conduit or passageway in the annular space 37.

Passageway 35 is closed at the rearward ends of the pipes 11, 35 by a rearward extension member or closure means 42. A plug 44 threaded within the closure device 42 carries a stop 46, which limits the rearward travel of piston 13 so that it never closes off the forward drive inlet 48. See FIG. 4.

As previously indicated, the forward extension member 41 provides a variety of functions. It provides a forward extension 43 of the chamber or cylinder 33. It also provides a housing for the spindle 81 with its bearings 87. It also contains the reverse drive inlet 45. In addition, it contains a passageway 47 (FIG. 3) which communicates with the forward end of passageway 37. It also contains the four-way valve or reversing switch, that is used for controlling the fluid drive system.

Hydraulic pressure (typically water under a pressure level of 100 PSI) is furnished through a hose 131 (FIG. 1) to a fluid supply passageway 61. This passageway is shown only in FIG. 2, in dotted lines. There is also an exhaust passageway 62, shown only in FIG. 2 in dotted lines which exhausts to atmosphere. The passageways 45, 61, 62, and the forward end of passageway 47, are all cylindrical openings which are parallel to each other. Furthermore, they fall on the 90 degree points of the locus of a circle, as best seen in FIG. 2.

Figure 2:
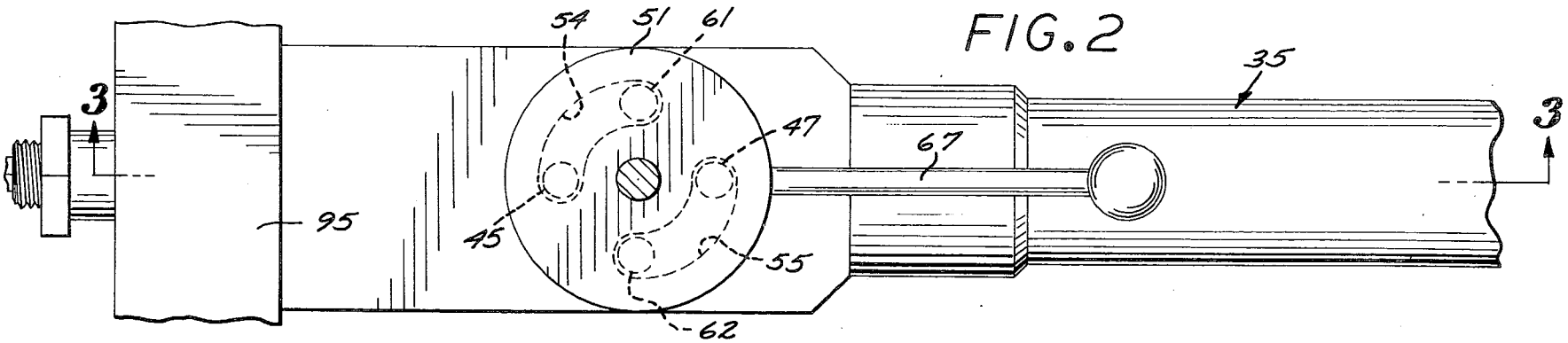
FIG. 2 is a longitudinal sectional view, in enlarged scale, taken along the line 2—2 of FIG. 1.

As best seen in FIGS. 1, 2 and 3, the extension member 41 is shaped generally in the configuration of a square bottle having a round top or neck portion. The round top or neck portion is fastened not only to the pipe 11 but also to the forward end of pipe 35. The openings 45, 61, 62, and the forward end of 47 are formed in a laterally extending direction in the square or base portion of the extension member 41. Above these four openings, as shown in FIGS. 1, 2, and 3, is the rotating cap 51 of a four-way valve. This cap has a pair of grooves 54, 55 on its undersurface, which grooves are shown in dotted lines in FIG. 2. In the reverse drive position as shown in FIG. 2, handle 67 attached to rotating cap 51 is positioned so that the groove 54 provides communication between passageways 61 and 45, while groove 54 provides communication between passageways 47 and 62. In an alternate position of the handle 67 and cap 51, not specifically shown, passageway 61 is coupled to passageway 47 while passageway 45 is coupled to the exhaust opening 62. The lower face of cap 51 contains appropriate O-ring 63, 64, and the cap is mounted for rotation by a bolt 53 (See FIG. 3).

While the forward and reverse drives of the present machine are in principle the same as shown in prior machines, and the four-way valve is generally similar in its operation, there are nevertheless significant differences in the structure. The arrangement of pipe 35 in circumdisposed relation to pipe 11 adds rigidity and strength to the main portion of the machine without undue addition to its weight. The parts are standard parts obtainable at minimum cost. The extension member 41 has its various openings and passageways machined from a single piece of metal. The four-way valve or reverse switch, the fluid drive hose 131 with its separate control valve, and the rotating drive motor 22, are all compactly arranged about the extension member 41 in positions where they are conveniently controlled by the operator.

The hydraulic flushing operation of the machine will now be described. As shown in FIg. 3, fluid openings 79 formed in the rear face of drive piston 13 communicate through a central passageway in the piston 13 and through a central passageway 77 in attachment device 75 with the hollow interior of the drive shaft 17. The fluid then flows into passageways 21 of the cutterhead 19 (FIG. 7) where they are discharged into the operative location of the cutterhead. The construction and mode of operation of the hydraulic flushing circuit is, in general, similar to that previously known in the art.

Thus in accordance with the present invention, as shown in drawing FIG. 3, the hollow drive 17 is square in cross-section but has a rounded rearward end which is internally screwed into a boss 75. The boss 75 has a large diameter portion with a large internal opening 77 therein. The rearward portion of the boss 75 is of smaller diameter and has a central opening 15 therein. The extreme rearward end of the boss 75 is externally threaded to receive a fastening nut. Drive piston 13 is a cylindrical member having a central opening which slides over the smaller size rearward end portion of the boss 75. The external surface of piston 13 has glands with O-rings 71, 73 seated therein for effective sliding seal contact with the cylinder 33, 43. The rear end face of cylinder 13 has a pair of openings 79 formed therein, each being radially located near the outer periphery of the piston face and being inclined at an angle of about 45° relative to the longitudinal axis of the piston. Each of the openings 79 communicates through the piston body and also through the lateral walls of the boss 75 with the central opening 15 therein.

The invention has been described in considerable detail in order to comply with the patent laws by providing a full public disclosure of at least one of tis forms. However, such detailed description is not intended in any way to limit the broad features or principles of the invention, or the scope of patent monopoly to be granted.

What is claimed is:

1. A machine for reaming heat exchanger tubes, comprising:

a hollow drive shaft adapted to be reciprocably driven along its longitudinal axis and having a cutterhead attached to its forward end and a drive piston attached to its rearward end;

an elongated inner cylindrical member providing a chamber for reciprocation of said drive piston therein;

an extension member attached to the forward end of said inner cylindrical member and having a cylindrical opening therein which provides an extension of said reciprocation chamber;

an outer elongated cylindrical member disposed about said inner member and substantially longitudinally coextensive therewith, said outer cylindrical member being of substantially larger diameter than said inner cylindrical member and thereby providing a longitudinally extending passageway between said two members;

closure means attached to the rearward ends of said inner and outer cylindrical members to close said passageway;

said extension member being also attached to the forward end of said outer cylindrical member for closing off the forward end of said passageway;

a forward drive opening formed in said inner cylindrical member near the rearward end thereof and communicating said passageway with said reciprocation chamber;

said extension member having a reversing drive opening extending laterally therein and communicating with said reciprocation chamber; and four-way valve means supported upon said extension member and selectively operable for applying fluid pressure either to said reversing drive opening, or through said passageway to said forward drive opening.

2. A hydraulically driven drilling or reaming machine comprising:

an elongated drive shaft having associated means for rotatably driving the same;

a piston rigidly affixed to the rearward end of said drive shaft;

means providing an elongated cylinder within which said piston is reciprocably mounted, said cylinder having fluid inlets at its forward and rearward ends;

one longitudinal portion of said cylinder being formed within a solid metallic body having an external flat surface that is generally parallel to the longitudinal axis of said cylinder, said flat surface having four openings formed therein and extending substantially perpendicular to said surface, the centers of said openings being arranged generally along the locus of a circle, two of said openings communicating with respective ones of said fluid inlets, another of said openings providing a fluid discharge path, and the remaining one of said openings being in communication with a source of fluid pressure; and a cap member rotatably disposed upon said flat surface and having a pair of grooves formed in its under side, each of said grooves providing fluid communication between two adjacent ones of said openings;

whereby said openings and said cap member cooperatively provide directional valve means that is selectively operable for applying fluid pressure to one or the other of said fluid inlets, thereby driving said piston either forwardly or rearwardly.

3. A hydraulically driven drilling or reaming machine comprising:

an elongated drive shaft having a cutterhead on its forward end and having associated means for rotatably driving said shaft;

a piston rigidly affixed to the rearward end of said drive shaft;

an inner cylindrical member, and an outer cylindrical member circumdisposed about said inner member to form a longitudinal passageway therebetween;

an extension member attached to the forward ends of said cylindrical members and having a cylindrical bore therein which together with said inner cylindrical member forms a cylindrical reciprocation chamber within which said piston is reciprocably mounted;

closure means attached to the rearward ends of said cylindrical members, the rearward end of said inner member also having an opening which couples said passageway to said reciprocation chamber;

said extension member being formed as a solid metallic body having an external flat surface that is generally parallel to the longitudinal axis of said chamber, said flat surface having four openings formed therein and extending substantially perpendicular to said surface, the centers of said openings being arranged generally along the locus of a circle, two of said openings communicating with the forward ends of said passageway and said reciprocating chamber, respectively, another of said openings providing a fluid discharge path, and the remaining one of said openings being in communication with a source of fluid pressure; and a cap member rotatably disposed upon said flat surface and having a pair of grooves formed in its under side, each of said grooves providing fluid communication between two adjacent ones of said openings;

whereby said openings and said cap member cooperatively provide directional valve means that is selectively operable for driving said piston either forwardly or rearwardly.

4. A drilling or reaming machine comprising:

inner and outer cylindrical members disposed to form a longitudinal passageway therebetween;

means supporting said cylindrical members relative to each other and cooperating therewith to form a fluid circuit in which fluid moves in one direction within said inner member and in the opposite direction within said longitudinal passageway;

means for coupling an external source of fluid pressure through said support means and into said fluid circuit;

directional valve means cooperatively associated with said support means and said coupling means and selectively operable for reversing the direction of fluid flow into said fluid circuit;

a drive shaft having a cutterhead on its forward end and a drive piston on its rearward end, said piston being adapted to be disposed within said inner cylindrical member with said drive shaft extending through and beyond said support means;

said drive shaft, drive piston, and cutterhead having a fluid discharge passageway extending therethrough whereby the application of fluid pressure to the rearward end of said piston biases said drive shaft in a forwardly direction and concurrently causes a stream of flushing fluid to flow through said discharge passageway and to exit from said cutterhead; and means for rotatably driving said shaft.

5. A drilling or reaming machine comprising:

an elongated member having forward and rearward ends, and having a longitudinal opening therethrough, said opening being enlarged at its forward end;

inner and outer cylindrical members attached to the rearward end of said base member and extending rearwardly therefrom, said inner member in cooperation with said base member opening forming a reciprocating drive chamber, and said outer member providing a longitudinal passageway alongside said inner member;

a rearward extension member attached to the rearward ends of said cylindrical members, said base member and the rearward end of said inner cylindrical member having passageways formed therein which cooperate with said drive chamber and said longitudinal passageway to provide a fluid flow circuit in which fluid may flow in one direction in said drive chamber and in the opposite direction in said longitudinal passageway;

means for coupling an external source of fluid pressure through said base member and into said fluid circuit;

directional valve means formed integral with said base member and in communication with said fluid source, and selectively operable for reversing the direction of fluid flow within said drive chamber;

an elongated drive shaft having a polygonal external configuration, a cutterhead on its forward end, and a drive cylinder on its rearward end, said drive cylinder being reciprocably disposed within said drive chamber; and kelly drive means supported within said enlarged forward end of said base member opening and receiving said drive shaft in longitudinal sliding relationship therewith, so as to drivingly rotate said drive shaft concurrently with the application of fluid pressure thereto in a longitudinal direction.

6. A drilling or reaming machine comprising:

an elongated base member integrally formed from a solid body and having a longitudinal opening formed therethrough, one end of said opening being enlarged;

a rotating bearing received within said enlarged opening;

a kelly drive spindle rotatably supported within said bearing;

an elongated drive shaft having a polygonal external configuration and having a drive cylinder on its rearward end, said drive cylinder being adapted to be received within said base member opening and said drive shaft extending through said spindle in longitudinally slidable relation therewith;

means attached to the rearward end of said base member and providing a rearward extension of said opening, thereby to provide a reciprocating chamber for movement of said drive cylinder and shaft;

passageway means associated with said base member and said base member extension means for providing a fluid circuit through said chamber;

directional valve means supported upon said base member and selectively operable in cooperation with said passageway means for providing a fluid inlet at one end or the other of said chamber; and means for providing fluid pressure from an external source through said valve means to said fluid circuit, thereby to drive said drive shaft in a longitudinal direction, said kelly drive spindle being concurrently operable for applying a rotary drive to said drive shaft;

said drive cylinder and drive shaft having a longitudinal discharge passageway formed therein for conveying flushing fluid to the forward end of said drive shaft.

* * * * *